US008539779B2

(12) United States Patent
Kim et al.

(10) Patent No.: US 8,539,779 B2
(45) Date of Patent: Sep. 24, 2013

(54) ICE MAKER, REFRIGERATOR HAVING THE SAME, AND ICE MAKING METHOD THEREOF

(75) Inventors: Seong-Jae Kim, Seoul (KR); Bong-Jin Kim, Seoul (KR); Young-Hoon Yun, Seoul (KR)

(73) Assignee: LG Electronics Inc., Seoul (KR)

( * ) Notice: Subject to any disclaimer, the term of this patent is extended or adjusted under 35 U.S.C. 154(b) by 689 days.

(21) Appl. No.: 12/756,904

(22) Filed: Apr. 8, 2010

(65) Prior Publication Data

US 2010/0319366 A1 Dec. 23, 2010

(30) Foreign Application Priority Data

Jun. 22, 2009 (KR) ..... 10-2009-0055656

(51) Int. Cl.
*F25C 5/02* (2006.01)

(52) U.S. Cl.
USPC ..... 62/71

(58) Field of Classification Search
USPC ..... 62/71, 74, 320, 340, 441, 449
See application file for complete search history.

(56) References Cited

U.S. PATENT DOCUMENTS 5,947,342 A * 9/1999 Song ..... 222/413
7,263,854 B2 * 9/2007 Lee et al. ..... 62/351
2006/0254285 A1 11/2006 Lin

FOREIGN PATENT DOCUMENTS

JP 6-2073 U 1/1994
KR 10-1999-001072 A 1/1999

* cited by examiner

*Primary Examiner* — Melvin Jones
(74) *Attorney, Agent, or Firm* — Birch, Stewart, Kolasch & Birch, LLP

(57) ABSTRACT

An ice maker, a refrigerator including the ice maker, and an ice making method are provided. The ice maker includes a tray having a predetermined length into which water is supplied to make ice. The ice maker is configured to mechanically separate the ice from the tray by using pistons which are driven by a motor. This permits the ice maker to have a reduced size, and occupy a small area, thereby implementing a slim configuration of a refrigerator. Furthermore, since an installation height of the ice maker is lowered, a path for supplying cool air may be shortened. This arrangement prevent loss of cool air being supplied to the ice making chamber.

14 Claims, 10 Drawing Sheets

ICE MAKER, REFRIGERATOR HAVING THE SAME, AND ICE MAKING METHOD THEREOF

RELATED APPLICATION

The present disclosure relates to subject matter contained in priority Korean Application No. 10-2009-0055656, filed on Jun. 22, 2009, which is herein expressly incorporated by reference in its entirety.

BACKGROUND OF THE INVENTION

1. Field of the Invention

The present invention relates to an ice maker, a refrigerator including the ice maker, and an ice making method, and particularly, to an ice maker that occupies a small space and provides an enhanced degree of spatial utilization and placement options within a refrigerator.

2. Background of the Invention

A home refrigerator serves to store food items in an accommodation space at a low temperature. The refrigerator is divided into a freezing chamber for storing food items at a temperature below zero degrees Celsius, and a refrigerating chamber for storing food items at a temperature above zero degrees Celsius. As demands for ice increases, a large number of refrigerators having automatic ice makers for making ice are being presented.

The ice maker may be installed at either the freezing chamber or the refrigerating chamber, depending on the type of refrigerator. In the case of installing the ice maker at the refrigerating chamber, cool air inside the freezing chamber is guided to the ice maker to perform an ice making operation.

Methods for separating ice from the ice maker may include a torsion method, an ejection method, and a rotation method. The torsion method is a method for separating ice by twisting the ice maker, the ejection method is a method for separating ice from the ice maker by an ejector installed above the ice maker, and the rotation method is a method for separating ice by rotating the ice maker.

However, the conventional ice makers and refrigerators provided with the conventional ice makers have several drawbacks.

Firstly, the conventional ice maker makes ice by containing water in a horizontal ice container. Here, the ice container occupies a large space, and an ice separation unit for separating ice from the ice maker occupies a large space. This may reduce the entire utilization space inside the refrigerator. Furthermore, in the case of reducing the size of the ice maker, the amount of ice that can be made at one time is reduced. This may cause ice not to be rapidly provided in summer when a large amount of ice is required.

Secondly, the conventional ice maker has a structure to drop formed ice downwardly to a location below the ice maker. Accordingly, in the case of a refrigerator having a dispenser, an ice making chamber has to be installed at a position higher than the dispenser. However, in the case of a 3-door bottom freezer type refrigerator where a freezing chamber is installed at a lower side and a refrigerating chamber including an ice making chamber is installed at an upper side, when the ice making chamber is installed at a high position, the freezing chamber is spaced far from the ice making chamber, and cooling air loss may occur when cool air from the freezing chamber is transferred to the ice making chamber. This may reduce the energy efficiency of the refrigerator.

Thirdly, the conventional ice maker has an ice making unit and an ice separating unit operated by individual mechanisms. This may cause the entire configuration and control to be complicated, resulting in an increase in the fabrication costs of the ice maker.

SUMMARY OF THE INVENTION

Therefore, an object of the present invention is to provide an ice maker having a slim configuration which occupies a small space within a refrigerator.

Another object of the present invention is to provide an ice maker locatable within a refrigerator at a location that permits a reduction of air loss occurring when cool air in a freezing chamber is supplied to an ice making chamber, by shortening a distance between the freezing chamber and the ice making chamber by lowering an installation height of the ice maker.

Still another object of the present invention is to provide an ice maker capable of reducing fabrication costs and reducing malfunctions thereof by having a simplified configuration and precise controls.

Still other objects of the present invention are to provide a refrigerator having the ice maker, and an ice making method thereof.

To achieve these and other advantages and in accordance with the purpose of the present invention, as embodied and broadly described herein, there is provided an ice maker, comprising: a tray having an ice making space; a piston for separating ice from the tray by pushing up the ice in a slidably coupled state to the tray; and a driving unit coupled to the piston, for up-down moving the piston.

To achieve these and other advantages and in accordance with the purpose of the present invention, as embodied and broadly described herein, there is also provided a refrigerator, comprising: a refrigerator body; a freezing chamber formed at the refrigerator body; a refrigerating chamber formed at the refrigerator body, and partitioned from the freezing chamber; an ice making chamber installed at the refrigerating chamber of the refrigerator body, for making ice by receiving cool air inside the freezing chamber; and an ice maker installed inside the ice making chamber, for making ice, wherein the ice maker separates ice from a tray by using an up-down motion of a piston.

To achieve these and other advantages and in accordance with the purpose of the present invention, as embodied and broadly described herein, there is still also provided an ice making method of a refrigerator, comprising: a water supplying step for supplying water to a tray; an ice making step for cooling the water contained in the tray, and thereby making ice; and an ice separating step for upwardly moving the ice inside the tray by a piston, cutting the ice, and transferring the cut ice to a preset position.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

A description will now be given in detail of the present invention, with reference to the accompanying drawings.

Hereinafter, an ice maker, a refrigerator having the same, and an ice making method thereof according to the present invention will be explained in more detail with reference to the attached drawings.

Figure 1:
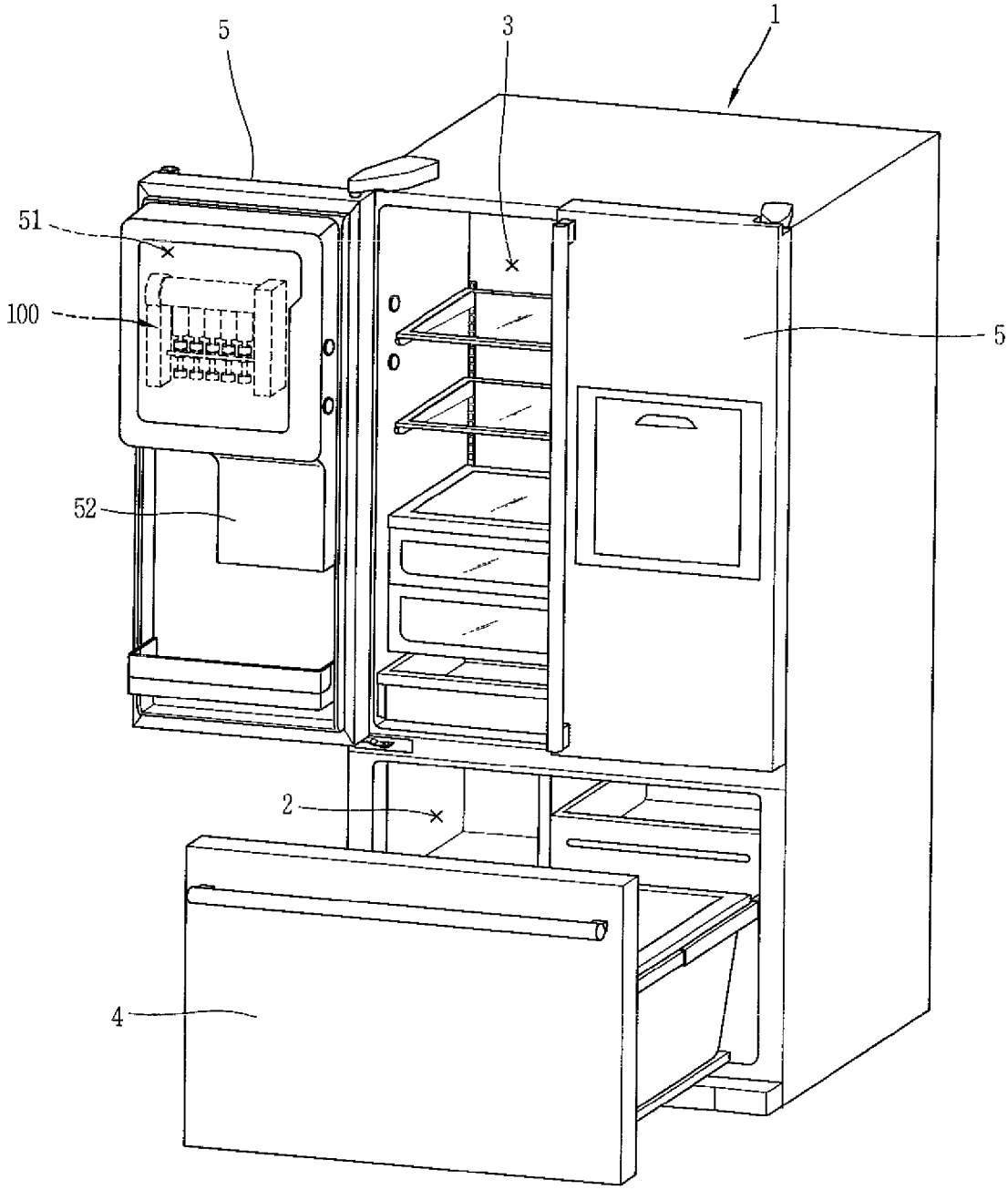
FIG. 1 is a perspective view of a bottom freezer type refrigerator having an ice maker according to the present invention.

Referring now to FIG. 1, the refrigerator according to the present invention comprises a freezing chamber 2 installed at a lower side of a refrigerator body 1 and configured to store food items at a temperature below zero degrees Celsius, and a refrigerating chamber 3 installed at an upper side of the refrigerator body 1 and configured to store food items at a temperature above zero degrees Celsius. A freezing chamber door 4 is slidably installed at the freezing chamber 2 so as to open and close the freezing chamber 2 in a drawer-like manner. A plurality of refrigerating chamber doors 5 are rotatably installed at both sides of the refrigerating chamber 3 so as to open and close the refrigerating chamber 3. A mechanical chamber is located at a lower end of a rear portion of the refrigerator body 1 where a compressor and a condenser are installed.

An evaporator for supplying cool air to the freezing chamber 2 or the refrigerating chamber 3 by being connected to the compressor and the condenser is installed at a rear portion of the refrigerator body 1, between an outer case and an inner case at a rear wall of the freezing chamber. However, the evaporator may be installed at a side wall or an upper wall or the refrigerator body. Alternatively, the evaporator may be installed at a barrier wall partitioning the freezing chamber 2 and the refrigerating chamber 3 from each other. One single evaporator may be installed only at the freezing chamber 2 to supply cool air to the freezing chamber 2 and the refrigerating chamber 3 in a distribution manner. Alternatively, a freezing chamber evaporator and a separate refrigerating chamber evaporator may be installed respectively, so as to independently supply cool air to the freezing chamber 2 and the refrigerating chamber 3.

An ice making chamber 51 for making ice and storing the ice is formed at an upper inner wall surface of the refrigerating chamber door 5. An ice maker 100 for making ice is installed inside of the ice making chamber 51. A dispenser 52 is located below the ice making chamber 51, so as to be outwardly exposed on a front side of the refrigerator chamber door 5, so that ice made by the ice maker 100 can be drawn out of the refrigerator.

The operation of the refrigerator will be explained as follows.

Once a load is detected from the freezing chamber 2 or the refrigerating chamber 3, the compressor is operated to generate cool air by the evaporator. A portion of the cool air is supplied to the freezing chamber 2 and the refrigerating chamber 3 in a distribution manner, whereas another portion of the cool air is supplied to the ice making chamber 51. The cool air supplied to the ice making chamber 51 is heat-exchanged so that ice can be formed by the ice maker 100 mounted at the ice making chamber 51, and then is returned into the freezing chamber 2 or is supplied to the refrigerating chamber 3. The ice made by the ice maker 100 is drawn out through the dispenser 52. These processes are repeatedly performed.

Figure 2:
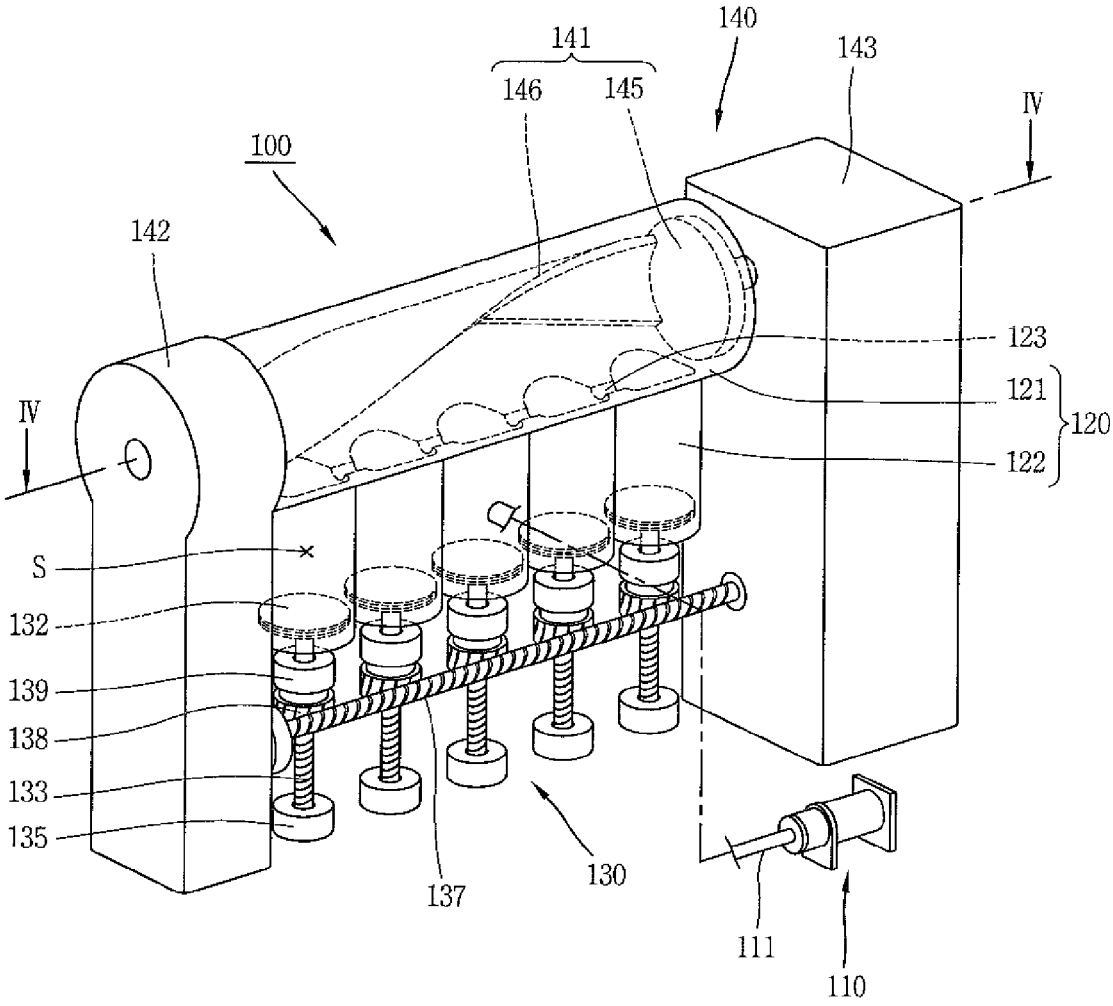
FIGS. 2 and 3 are perspective views showing an operation state of the ice maker of FIG. 1 according to an up or down position of a piston.
Figure 3:
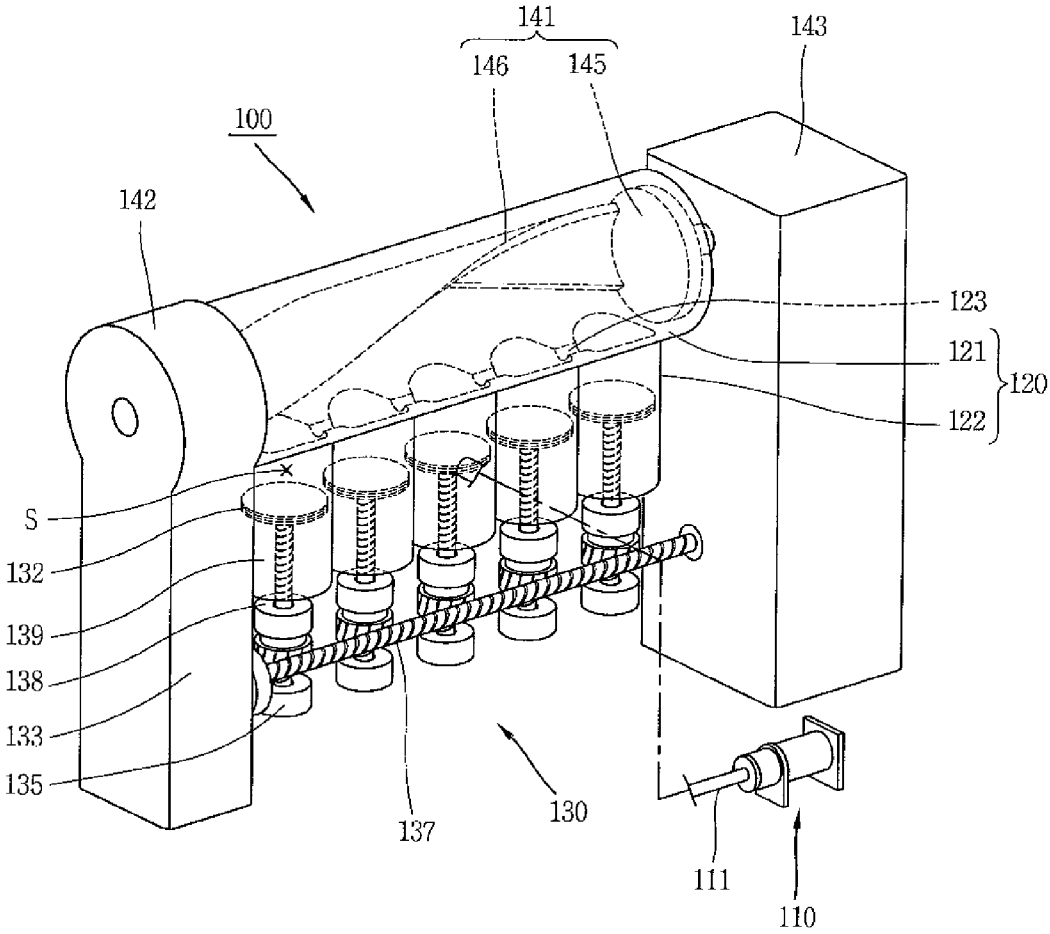

As shown in FIGS. 2 and 3, the ice maker 100 includes a water supply unit 110 connected to a water supply source for supplying water, a tray 120 for performing an ice making operation by receiving the water supplied from the water supply unit 110, an ice separation unit 130 for separating ice made in the tray 120 from the tray 120 in a push-up manner, and a transfer unit for transferring the ice (I) separated from the tray 120 to the dispenser 52 after cutting the ice (I) into a proper size.

Figure 4:
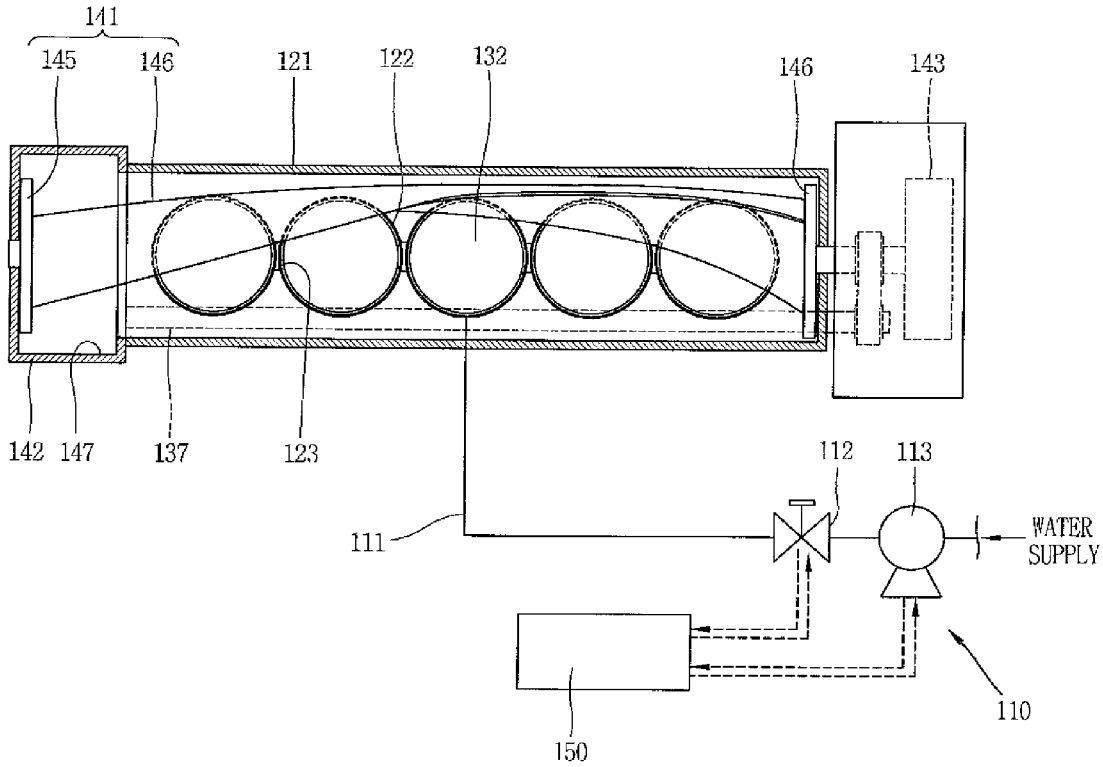
FIG. 4 is a sectional view taken along line 'IV-IV' in FIG. 2.

As shown in FIGS. 2 to 4, the water supply unit 110 includes a water supply pipe 111 for connecting the water supply source to the tray 120, a water supply valve 112 installed at an intermediate part of the water supply pipe 111 for controlling a water supply amount. A water supply pump 113 may be provided at an upstream side or a downstream side of the water supply valve 112 for pumping water. The water supply pump 113 serves to supply a uniform water pressure and flow. However, the water supply pump 113 is not necessarily required. For example, where the water supply pump 113 is not provided, water supply may be performed by using a height difference between the water supply source and the tray 120, or by water pressure of the source.

The water supply pipe 111 may be independently connected to ice making tubes 122 of the tray 120 to be later explained. However, as shown in the drawings, the water supply pipe 111 is connected to one ice making tube 122, especially, the intermediate ice making tube 122, and the other ice making tubes are in fluid communication with the intermediate ice making tube to permit water flow among the ice making tubes 122, which is preferable in terms of controls and fabrication costs.

The water supply pipe 111 may be directly connected to the water supply source for supplying water. In addition, the water supply pipe 111 may be connected to a water tank provided in the refrigerating chamber 3 and storing a predetermined amount of water therein. In this case, the water tank serves as the water supply source. In order to supply a predetermined amount of water to each of the ice making tubes 122 of the tray 120, a water level sensor may be installed at the tray 120, a flow amount sensor for sensing a flow amount of water may be installed at the water supply pipe, or a water level sensor may be installed at the water tank.

The water supply valve 112 and the water supply pump 113 may be electrically connected to a control unit 150 so as to exchange signals with each other. The control unit 150 may control a water supply amount based on a real time value sensed by the water level sensor or the flow amount sensor.

Alternatively, the control unit 150 may periodically turn on/off the water supply valve 112 and the water supply pump 113 by setting an operation time of the water supply valve 112 and the water supply pump 113 according to predefined data.

A single tray 120 may be provided according to an ice making capacity of the refrigerator. However, a plurality of trays 120 may be provided for increasing an ice making capacity of the refrigerator. When a plurality of trays 120 are provided, the plurality of trays 120 may be arranged in one line, or may be arranged in plurality of lines, taking into consideration the relationships with the peripheral components. In order to minimize each width of the trays 120 in back and forth directions, the trays 120 are preferably arranged on the same plane in one line. However, in order to minimize each width of the trays 120 in right and left directions, the trays 120 are preferably arranged in a plurality of lines. The arrangement of the trays 120 may be suitably controlled according to particular needs.

As shown in FIGS. 2 and 3, the tray 120 includes a housing 121 formed to have a long length in a horizontal direction, and a plurality of ice making tubes 122 disposed below the housing 121 so as to be in parallel in a horizontal direction, and having ice making spaces (S) communicated with a lower portion of the housing 121.

The housing 121 and the ice making tubes 122 may be integrally formed with each other. Alternatively, the ice making tubes 122 may be respectively assembled to the housing 121 by welding or other fastening methods. For instance, in the case of integrally forming the housing 121 and the ice making tubes 122 with each other, the ice making tubes 122 may be formed in a cylindrical shape so that upper and lower ends thereof are open. This is preferable for facilitation of the assembly of pistons 131 to be explained later. However, in the case of assembling the ice making tubes 122 to the housing 121, the ice making tubes 122 may be formed so that the upper ends thereof are open, while the lower ends thereof are closed. In this case, through holes may be formed at the center of the closed lower ends of the ice making tubes 122 for permitting rod portions 133 of the pistons 131 to slidably penetrate therethrough.

As shown in FIGS. 2 to 4, the water supply pipe 111 for supplying water may be connected to one of the ice making tubes 122, for example, the intermediate ice making tube 122. In addition, a water flow path 123 may be formed so that water can be transferred to both ice making tubes 122 adjacent to the intermediate ice making tube 122. The water flow path 123 may be implemented as holes, or grooves formed at upper ends of the openings of the ice making tubes 122.

The ice separation unit 130 includes a plurality of pistons 131 for linearly moving ice upwardly within the ice making tubes 122, and a driving unit 136 for moving the pistons 131 upwardly and downwardly.

Figure 5:
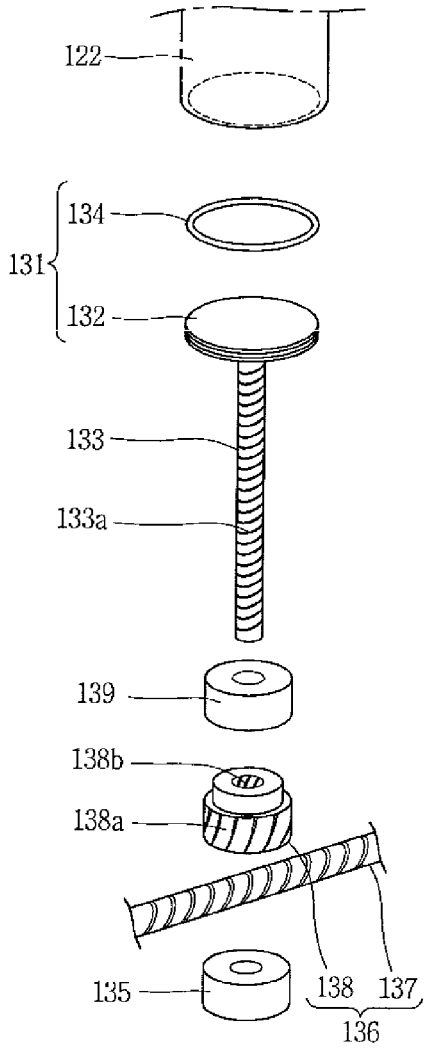
FIG. 5 is an exploded perspective view showing a configuration of the piston of FIGS. 2 and 3.

As shown in FIGS. 2, 3 and 5, the pistons 131 include head portions 132 slidably coupled to inner circumferential surfaces of the ice making tubes 122, to thereby form ice making spaces (S), for pushing up the ice, and rod portions 133 integrally formed at bottom surfaces of the head portions 132 or assembled thereto, for receiving a driving force of the driving unit 136.

The head portions 132 may be formed in a disc shape having nearly the same size as an inner diameter of the ice making tubes 122. Gaskets 134 having a ring shape may be coupled to outer circumferential surfaces of the head portions 132 for prevention of leakage of water filled in the ice making spaces (S). Alternatively, the head portions 132 may have an oval shape, or a rectangular or square shape, for slidably coupling with a correspondingly shaped oval, rectangular or square ice making tube 122.

The rod portion 133 may be formed to have a predetermined length in a vertical direction. Screw threads 133*a* are formed on outer circumferential surfaces of the rod portions 133, and are engaged with inner portions of driven gears 138, so that the rod portions 133 are moved up or down when the driven gears 138 rotate. Stoppers 135 for limiting an up-motion height of the pistons 131 may be formed at lower ends of the rod portions 133. The stoppers 135 may be formed in a sleeve shape to be assembled to the rod portions 133.

The driving unit 136 includes a driving gear 137 installed in a horizontal direction and rotated in the horizontal direction (first axial direction), and driven gears 138 engaged with the driving gear 137 and the pistons 131, for moving the pistons 131 up and down while the driven gears 138 are rotated in a longitudinal direction (second axial direction perpendicular to the first axial direction) by the driving gear 137.

The driving gear 137 is implemented as bar-shaped worm gear having a length longer than a horizontal length of the tray 120, and the driven gears 138 are implemented as ring-shaped worm wheels. The driven gears 138 have outer gears 138*a* on outer circumferential surfaces thereof so as to be engaged with the driving gear 137. The driven gears 138 additionally have inner gears 138*b* on inner circumferential surfaces thereof so as to be engaged with the screw threads 133*a* of the rod portions 133 attached to the pistons 131.

The driving gear 137 and the driven gears 138 may be coupled to a rotation shaft of a driving motor for rotating a cutter by using one or a plurality of intermediate gears. However, the driving gear 137 and the driven gears 138 may be coupled to the rotation shaft of the driving motor by a driving force transmitting member such as a belt, chain, or other flexible force transferring member.

The driven gears 138 may be rotatably coupled to worm wheel bases 139, and the worm wheel bases 139 may be fixedly installed to an inner wall surface of the ice making chamber 51.

The ice inside the ice making tubes 122 may be separated from the ice making tubes 122 by an upward motion of the pistons 131, i.e., by a pushing force of the pistons 131 generated by a driving motor 143, without applying heat to the ice making tubes 122. Alternatively, the ice may be separated from the ice making tubes 122 by applying a predetermined amount of heat to the ice making tubes 122 by a heater installed on an outer peripheral surface of the tray 120, before the ice is pushed up by the pistons 131.

The heater may be implemented as a hot wire heater wound on an outer peripheral surface of the tray 120. In this case, the heater may be formed as a single circuit or a plurality of circuits according to the shape of the tray 120.

The heater may be controlled so as to be communicated with the water supply unit 110. For instance, a microcomputer may determine whether water is being supplied to the tray 120 for ice making, whether an ice making operation is being performed, or whether the ice made in the tray 120 is being separated from the tray 120, according to changes of values sensed by the water level sensor or the flow amount sensor of the water supply unit 110. If it is determined that water is being supplied to the tray 120 for ice making, or if it is determined that an ice making operation is being performed, the operation of the heater is stopped. However, if it is determined that the ice made in the tray 120 is being separated from the tray 120, the operation of the heater is started.

The time to operate the heater may be determined by real-time or periodically sensing the temperature of the tray 120.

Alternatively, the heater 131 may be forcibly operated based on a data value set to indicate a lapsed time after changes of values sensed by the water level sensor or the flow amount sensor of the water supply unit 110. That is, whether the ice making operation has been completed or not may be checked by sensing the temperature of the tray 120, or through an ice making time. For instance, when the temperature of the tray 120 measured by a temperature sensor mounted at the tray 120 is less than a predetermined temperature (e.g., about −9 degrees Celsius), it is determined that the ice making operation has been completed. Alternatively, when a predetermined time lapses after a water supply operation, it is determined that the ice making operation has been completed.

Although not shown, the heater may be also implemented as a conductive polymer, a plate heater with a positive thermal coefficient, an AL thin film, or a heat transfer material, rather than the aforementioned hot wire heater.

Rather than being attached onto the outer peripheral surface of the tray 120, the heater may instead be installed inside the tray 120, or may be provided on an inner surface of the tray 120. Alternatively, the tray 120 may be implemented as a heating resistor which emits heat when electricity is applied to one or more parts thereof. This may allow the tray 120 to serve as the heater without installing an additional heater.

The heater may operate as a heat source by being installed at a position spaced from the tray 120 by a predetermined interval, without coming in contact with the tray 120. As another example, the heat source may be implemented as an optical source for irradiating light to at least one of the ice and the tray 120, or a magnetron for irradiating microwaves to at least one of the ice and the tray 120. The heat source such as the heater, the optical source, and the magnetron melts a part of an interface between the ice and the tray 120, by applying thermal energy to at least one of the ice and the tray 120, or the interface therebetween. Accordingly, once the pistons 131 are operated, the ice is separated from the tray 120 by the pistons 131 even in a condition where the interface between the ice and the tray 120 has not melted completely.

The transfer unit 140 includes a cutter 141 rotatably installed at an inner space of the housing 121 and configured to cut the ice (I), a chute tube 142 for guiding the ice cubes cut by the cutter 141 to the dispenser, and a driving motor 143 for rotating the cutter 141.

As shown in FIGS. 2 and 4, the cutter 141 includes a plurality of cutter plates 145 rotatably disposed and spaced apart from each other by a predetermined distance, and one or more blades 146 formed in a spiral shape with both ends thereof coupled to surfaces of the two cutter plates 145.

One of the cutter plates 145 adjacent to the driving motor 143 is coupled to a rotation shaft of the driving motor 143, whereas the other of the cutter plates 145 is rotatably coupled to the chute tube 142.

Since the ice (I) made in the ice making tubes 122 and pushed up is a contiguous (non-cut) ice mass having a cylindrical shape, the cutter 146 may be formed in a wound shape by about 180° so as to smoothly cut the ice (I).

Since the two cutter plates 145 are connected to each other only by the blade 146 without using an additional bar, the ice may be smoothly upwardly moved from the tray 120 without being blocked by the cutter 141.

The cutter 141 may be formed in other ways to cut the ice mass into separated ice pieces having a proper size. In case of forming the blade 146 of the cutter 141 in a screw shape, the blade 146 can move the ice (I) in a consecutive push manner. This may allow a free configuration of an arrangement shape of the tray 120 or a direction to draw out the ice. Furthermore, in case of forming the blade 146 of the cutter 141 in a screw shape, the number of the chute tubes 143 and the position of the ice drawing opening 147 may be varied. More specifically, when the screw of the blade 146 is implemented in one direction as shown in FIG. 4, the ice drawing opening 147 is formed at one end of the blade 146. However, when the screw of the blade 146 is implemented in two directions, the ice drawing opening 147 may be formed at both ends of the blade 146, or at an intermediate part of the blade 146.

The chute tube 142 may be formed in a cylindrical shape or a quadrangular shape having nearly the same diameter as the housing 121. The end of the chute tube 142 may be directly connected to the dispenser, or to an ice storage container.

Figure 6:
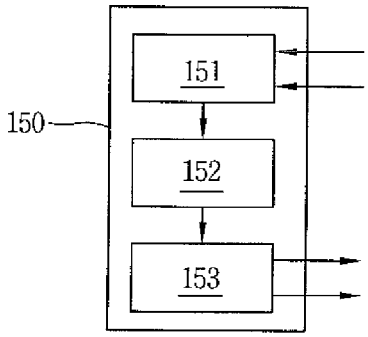
FIG. 6 is a schematic view showing a configuration of a control unit of FIG. 4.
Figure 7A:
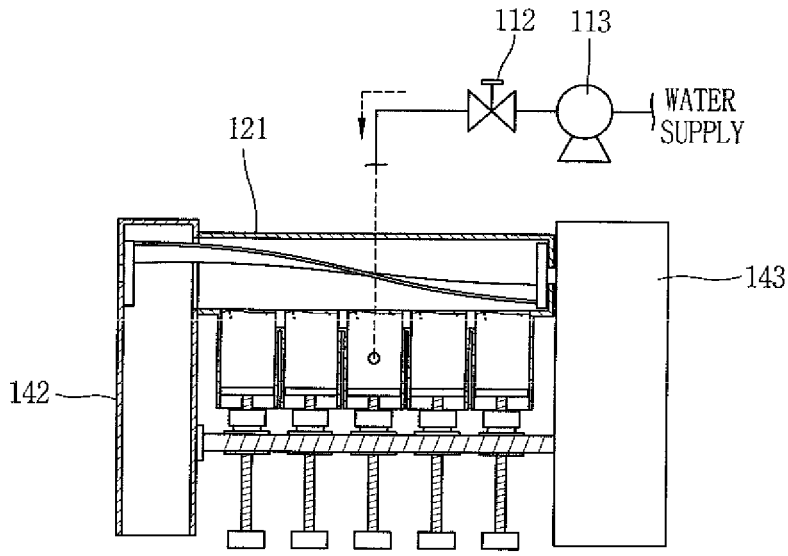
FIGS. 7(*a*)-7(*d*) are longitudinal sectional views of the ice maker of FIGS. 2 and 3 showing an ice making process.
Figure 7B:
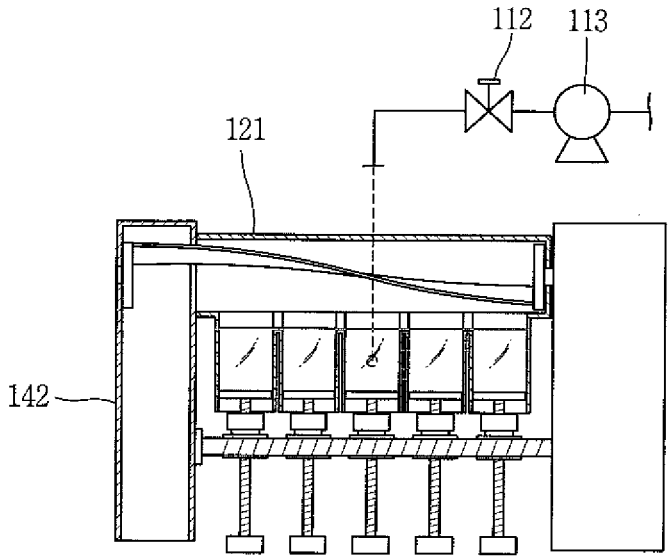
Figure 7C:
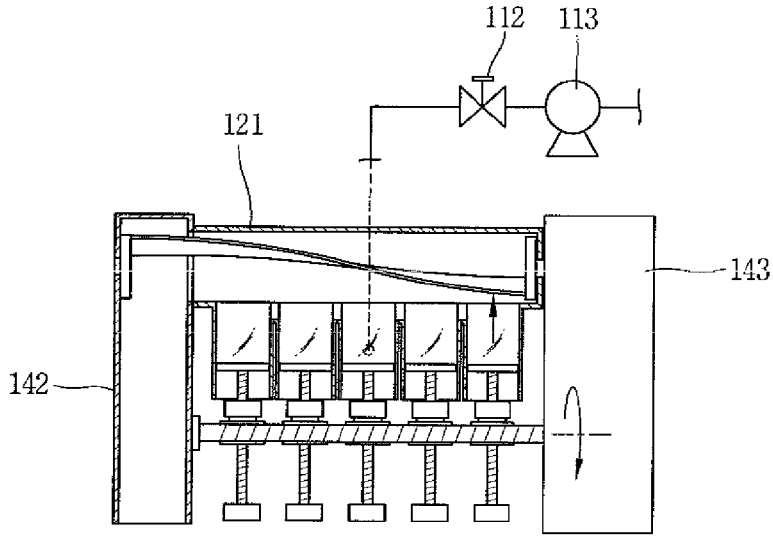
Figure 7D:
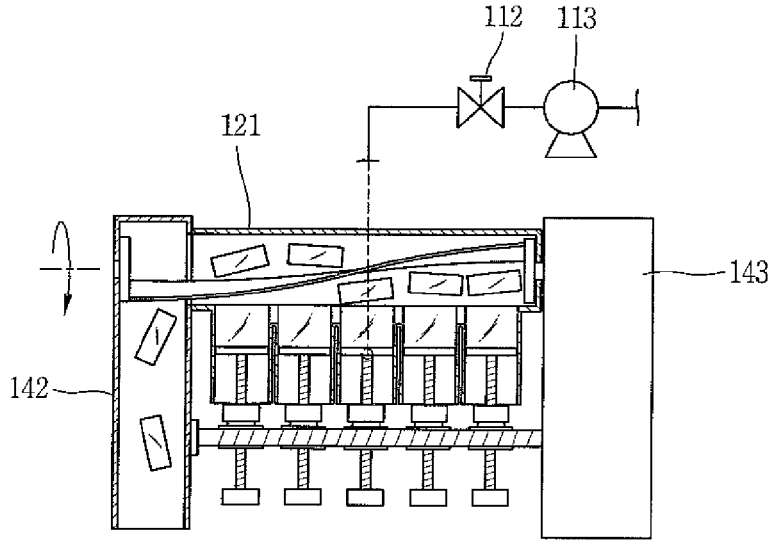

The driving motor 143 may be controlled by a control unit 150, for example a microcomputer, electrically connected to the driving motor 143. For instance, as shown in FIG. 6, the control unit 150 includes a sensing unit 151 for sensing the temperature of the tray 120 or sensing a lapsed time after water supply, a determination unit 152 for determining whether the ice making operation has been completed or not by comparing the temperature or time sensed by the sensing unit 151 with a reference value, and a command unit 153 for controlling whether to operate the driving motor 138 based on the determination by the determination unit 152. If a heater is provided, the control unit 150 may also control the operation of the heater.

Figure 8:
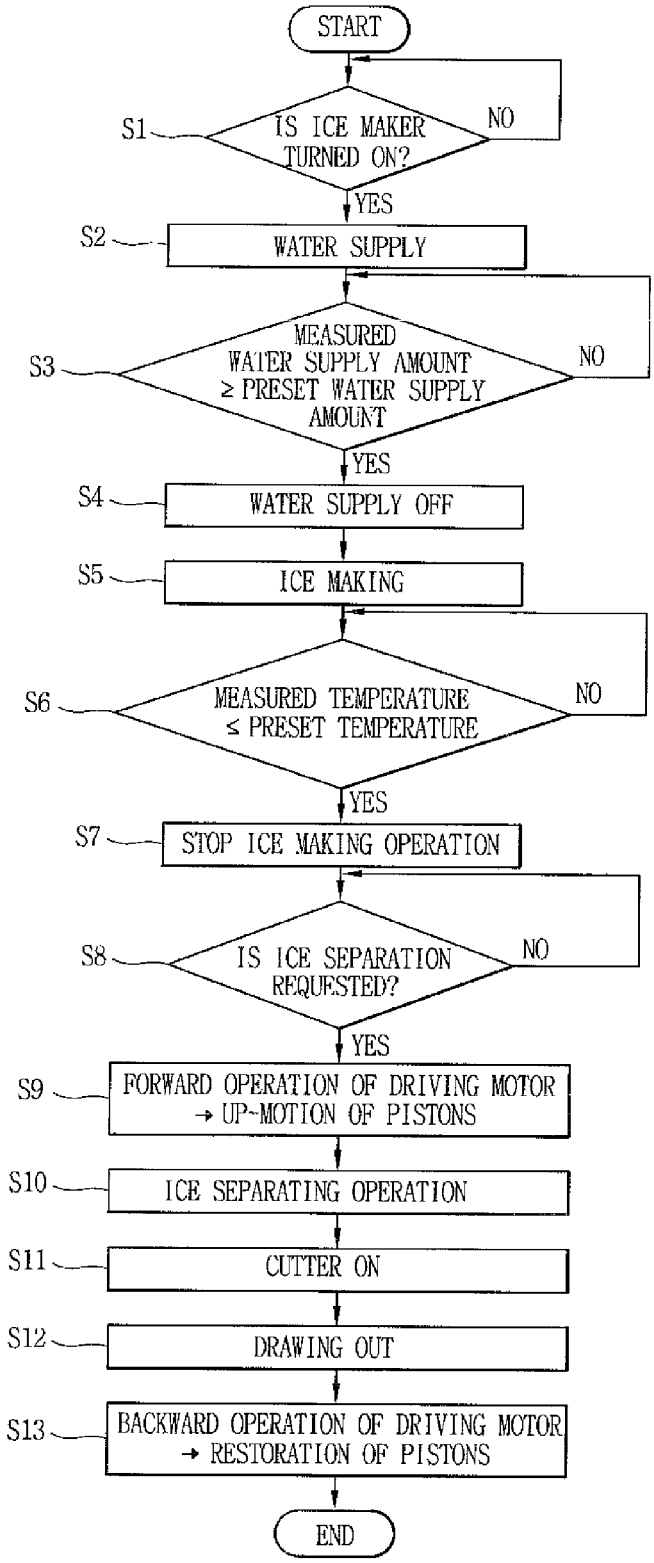
FIG. 8 is a flowchart showing an ice making process by the ice maker of FIGS. 2 and 3.

Referring now to FIGS. 7 and 8, once ice making is requested, the ice maker 100 is turned on, and an ice making operation starts (51). Once the ice making operation starts, the water supply unit 110 supplies water to the ice making tubes 122 of the tray 120 (S2). Here, a water supply amount is real-time sensed by a water level sensor installed at the tray 120, or a flow amount sensor installed at a water supply pipe, or a water level sensor installed at a water tank, etc. Then, the sensed water supply amount is transmitted to the microcomputer 150. And, the microcomputer 150 compares the received water supply amount with a preset water supply amount (S3). Based on the comparison, it is determined whether a preset amount of water has been supplied to the ice making tubes 122 of the tray 120. If it is determined that a preset amount of water has been supplied to the ice making tubes 122 of the tray 120, a water supply valve of the water supply unit 110 is blocked to stop a supply of water to the ice making tubes 122 of the tray 120.

Once the water supply to the ice making tubes 122 of the tray 120 has been completed, the water inside the tray 120 is exposed to cool air supplied to the ice making chamber 51 for a predetermined time, to be frozen (S5). While the water inside the tray 120 is being frozen, a temperature sensor periodically or real-time senses the temperature of the tray 120 to transmit the sensed temperature to the microcomputer 150. Then, the microcomputer 150 compares the sensed temperature with a preset temperature (S6). Based on this comparison, it is determined whether the surface of the water inside the tray 120 has been frozen. If it is determined that the water inside the tray 120 has been frozen, all the processes are stopped to convert the current operation into the ice separating operation (S7~S8).

Once ice separation is requested, the driving motor 143 is operated by the control unit 150. As the driving motor 143 is operated, the driving gear 137 (worm gear) is rotated. Then, the driving gear 137 rotates the driven gears 138 (worm wheels), and thus the driven gears 138, which are coupled to the screw threads 133*a*, move the pistons 131 upwardly (S9). Then, the head portions 132 of the pistons 131 push up the ice. As the ice is upwardly moved toward the cutter 141, the ice separating operation is performed (S10).

In an arrangement where a heater is used, the heater and the driving motor 143 are operated by the control unit 150. Once the heater is operated, heat is supplied to the tray 120, thereby melting an outer surface of the ice contacting an inner surface of the tray 120. Accordingly, the ice is easily separated from the tray 120.

Next, while the driving gear 137 is rotated by the driving motor 143, the cutter 141 also starts to be rotated (S11). Accordingly, the ice inside the tray 120 is pushed up to be cut into a predetermined size. Then, the cut ice cubes are transferred to the chute tube 142 by the blade 146, and subsequently discharged toward the dispenser, or toward an ice storage container (S12).

While the ice is being separated from the tray 120 or while the ice separating operation is prepared, supply of cool air to the ice making chamber 51 is preferably stopped in order to facilitate the ice separating operation, and in order to reduce power supplied to the heater in the case of implementing the heater.

Once the ice discharging operation is completed, the operation of the cutter 141 is stopped. And, the driving motor 143 is operated in a reverse direction to restore the pistons 131 to the original positions (S13). While the water supply valve 112 is opened, a proper amount of water is supplied to the ice making tubes 122 of the tray 120 by the water level sensor and the flow amount sensor, etc. These processes are repeatedly performed. In the case of implementing the heater, the operation of the heater is also stopped.

Under these configurations, because the ice making unit and the ice separation unit are integrally formed with each other, the entire size of the ice maker may be reduced, and thus a refrigerator having the ice maker may be implemented to have a slim configuration. More specifically, in the conventional art, the tray has a wide width, and the ice separation unit for separating ice from the ice maker has a wide width. Accordingly, the conventional refrigerator having the ice maker has a limitation in having a slim configuration. However, in the present invention, since the ice maker is provided with the tray having a small thickness, an occupation area occupied by the ice maker in the refrigerator is small.

Furthermore, since an installation height of the ice maker is lowered, a path for supplying cool air may be shortened. This may prevent loss of cool air being supplied to the ice making chamber. More specifically, in the conventional art, an ice storage container is provided for storing ice made by the ice maker. However, in the present invention, the tray having a long shape in upper and lower directions serves to store a predetermined amount of ice therein, thereby eliminating the need for an additional ice storage container. Accordingly, the ice maker has a lowered installation height, thereby reducing the distance between the freezing chamber and the ice making chamber. This may shorten the path for supplying cool air, thereby reducing loss of cool air, and reducing loss of an input for driving the ice maker.

Furthermore, since the ice maker has a simplified configuration and precise operation controls, the fabrication costs may be reduced, and inferiority of the ice maker due to malfunctions may be prevented. More specifically, in the conventional art, ice is separated from the ice maker by a torsion method, a heating method, a rotation method, etc. However, in the present invention, ice is mechanically separated from the ice maker by using a rotation force of the driving motor which rotates the cutter. This may allow the ice maker to have a simplified configuration and precise operation controls. As a result, the fabrication costs for the ice maker may be reduced, and inferiority of the ice maker due to malfunctions may be prevented to enhance reliability of the ice maker.

Hereinafter, an ice maker according to another embodiment of the present invention will be explained.

Figure 9:
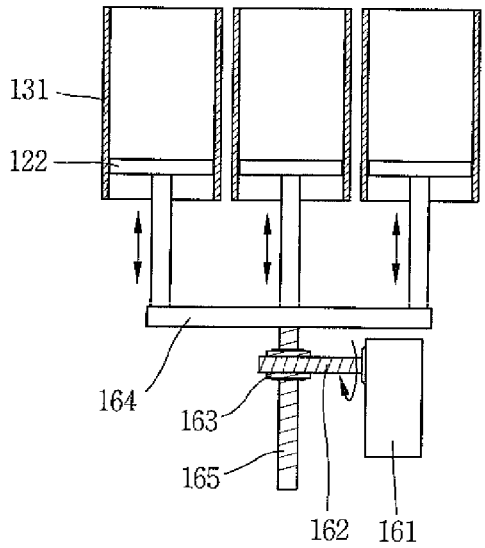
FIG. 9 is a schematic view showing the ice maker of FIG. 1 according to another embodiment of the present invention.

In the aforementioned embodiment, one driving motor is used to control the up-down motion of the pistons and the rotation motion of the cutter. However, in another embodiment of the present invention, a driving motor for controlling the up-down motion of the pistons and a driving motor for controlling the rotation motion of the cutter are independently provided from each other. For instance, as shown in FIG. 9, a piston moving driving motor 161 may be additionally provided at a lower end of one end of the tray 120, and a driving gear 162 may be additionally provided at a rotation shaft of the piston moving driving motor 161. And, a driven gear 163 coupled to the pistons 131 may be coupled to the driving gear 162 so as to be engaged with each other. In an arrangement including a plurality of pistons 131, the plurality of pistons 131 may be coupled to a first frame 164, and a second frame 165 may be coupled to the first frame 164 so as to be coupled to the driven gear 163 by a screw.

In this case, the ice maker according to this second embodiment has similar configurations and effects as those of the ice maker according to the first embodiment, and thus detailed explanations thereof will be omitted. The ice maker according to the second embodiment where the piston moving driving motor 161 is additionally provided is different from the ice maker according to the first embodiment in that the driving force transmitting member, the worm gears, the worm wheels, etc. need not be provided at a narrow space. This may facilitate the assembly process and controls, and reduce malfunctions of the ice maker as the cutter and the pistons are independently operated.

The refrigerator having the ice maker according to the present invention has the following operation and effects.

In case of a 3-door bottom freezer type refrigerator having the ice making chamber at the refrigerating chamber and operating the ice maker by guiding cool air to the ice making chamber from the freezing chamber, a space occupied by the ice maker may be reduced, thereby providing a slim configuration of the refrigerator. In case of a built-in refrigerator having a reduced depth in a front-to-rear direction for combination with other structures, a refrigerating chamber door may have a reduced thickness by applying the ice maker thereto. This may enhance a degree of freedom to install the refrigerator.

Figure 10:
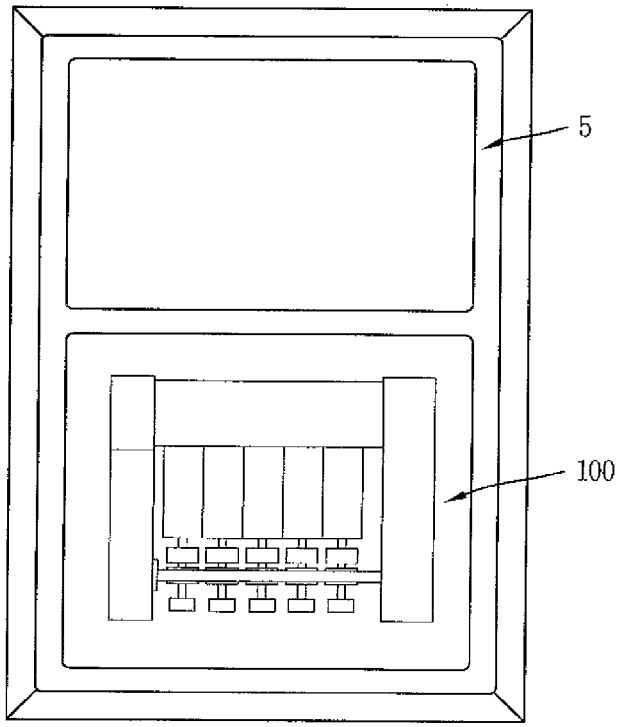
FIGS. 10 and 11 are a rear view and a side sectional view each showing an arrangement structure of the ice maker of FIGS. 2 and 3 and a dispenser according to another embodiment of the present invention.
Figure 11:
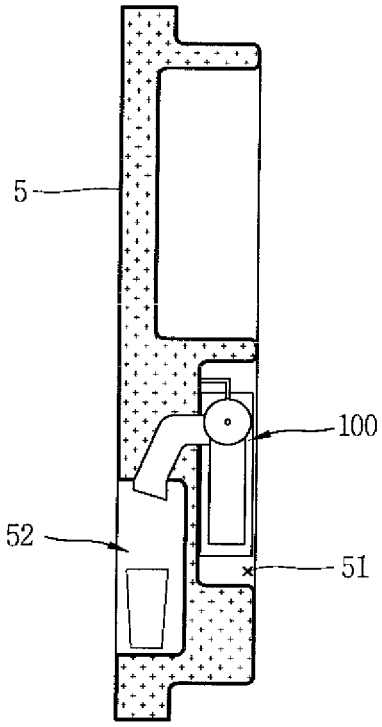

In case of applying the ice maker to the refrigerator, the cutter 141 is installed on an upper end of the tray 120, thereby discharging the ice from an upper side of the ice maker. Accordingly, as shown in FIG. 10, the ice maker 100 may be arranged at a lower side of the refrigerating chamber door 5 beside the dispenser 52 in a width direction at approximately the same height as the dispenser. Alternatively, as shown in FIG. 11, the ice maker 100 and the dispenser 52 may be arranged in back and forth directions such that the ice maker 100 is located behind the dispenser 52 in a thickness direction of the refrigerating chamber door 5. This may reduce a length of a flow path between the freezing chamber 2 and the ice making chamber 51. Accordingly, loss of cool air that may occur while supplying cool air to the ice making chamber 51 from the freezing chamber 2 may be greatly reduced, thereby lowering power consumption of the refrigerator. This may also increase an effective volume of the refrigerating chamber door.

The ice maker, the refrigerator having the same, and the ice making method thereof maybe applicable to all types of refrigerating appliances having ice makers, such as two-door refrigerators, side-by-side refrigerators, and stand-alone freezers without refrigerating chambers.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds, are therefore intended to be embraced by the appended claims.

What is claimed is:

1. An ice maker, comprising:

a tray configured to produce an ice mass;

an ice elevating member linearly movable within the tray and configured to elevate the ice mass located within the tray; and a driving unit coupled to the ice elevating member and configured to linearly move the ice elevating member, wherein the ice elevating member is configured to elevate the ice mass so that an upper portion of the ice mass is located above the tray.

2. The ice maker of claim 1, wherein the tray comprises a plurality of ice making cylinders each having an ice making space and connected to each other, and wherein the ice elevating member includes a plurality of pistons slidably movable within the ice making cylinders in a longitudinal direction of the ice making cylinders.

3. The ice maker of claim 2, wherein the plurality of ice making cylinders are provided with a water flow path such that the ice making spaces are communicated to each other, and wherein a water supply unit is connected to at least one of the plurality of ice making cylinders.

4. The ice maker of claim 1, wherein the tray comprises an ice making cylinder having an ice making space, and wherein the ice elevating member includes a piston slidably movable within the ice making cylinder in a longitudinal direction of the ice making cylinder.

5. The ice maker of claim 4, wherein the piston comprises:

a head portion slidably coupled to an inner circumferential surface of the ice making cylinder; and a rod portion coupled to the head portion, for receiving a driving force of the driving unit.

6. The ice maker of claim 4, wherein the driving unit comprises:

a driving gear rotated in a first axial direction; and a driven gear engaged with the driving gear and the piston, and rotated in a second axial direction perpendicular to the first axial direction, for elevationally moving the piston.

7. The ice maker of claim 6, wherein the piston comprises:

a head portion slidably coupled to an inner circumferential surface of the ice making cylinder; and a rod portion coupled to the head portion, for receiving a driving force of the driving unit, the rod portion including a screw thread engaged with the driven gear, wherein a stopper for limiting up-motion of the piston is provided at a lower end of the rod portion.

8. The ice maker of claim 1, further comprising an ice separating unit configured to separate the upper portion of the ice mass from a remaining portion of the ice mass.

9. The ice maker of claim 8, wherein the ice separating unit includes a cutter for cutting the ice pushed up by the ice elevating member, and wherein the cutter is operated by the driving unit.

10. The ice maker of claim 9, wherein the cutter comprises:

a pair of support members spaced-apart in a horizontal direction, one of the support members being coupled to a rotation shaft of the driving unit; and a blade having a spiral shape, the blade having opposite ends thereof coupled to the pair of support members.

11. An appliance, comprising:

a body including an ice making chamber; and an ice maker located in the ice making chamber, the ice maker including:

a tray configured to produce an ice mass;

an ice elevating member linearly movable within the tray and configured to elevate the ice mass located within the tray; and a driving unit coupled to the ice elevating member and configured to linearly move the ice elevating member, wherein the body is a refrigerator body having a refrigerating chamber and a freezing chamber, and wherein the ice making chamber is located in the refrigerating chamber.

12. The appliance of claim 11, further comprising a door configured to open and close the refrigerating chamber, wherein the ice making chamber is located at the door.

13. The appliance of claim 12, further comprising a dispenser located at the refrigerator door for drawing out ice made in the ice making chamber, wherein at least a portion of the ice making chamber is located at a same height as a portion of the dispenser.

14. An ice maker, comprising:

a tray configured to produce an ice mass;

an ice elevating member linearly movable within the tray and configured to elevate the ice mass located within the tray;

a driving unit coupled to the ice elevating member and configured to linearly move the ice elevating member; and an ice separating unit configured to separate the upper portion of the ice mass from a remaining portion of the ice mass, wherein the ice separating unit includes a cutter for cutting the ice pushed up by the ice elevating member, wherein the cutter is operated by the driving unit, and wherein the cutter comprises:

a pair of support members spaced-apart in a horizontal direction, one of the support members being coupled to a rotation shaft of the driving unit; and a blade having a spiral shape, the blade having opposite ends thereof coupled to the pair of support members.

* * * * *